US006663259B2

(12) United States Patent
Westfall

(10) Patent No.: US 6,663,259 B2
(45) Date of Patent: Dec. 16, 2003

(54) DECORATIVE LIGHTING FRAME

(76) Inventor: Deborah Westfall, 178 Deer Chase Dr., Jasper, GA (US) 30143

( * ) Notice: Subject to any disclaimer, the term of this patent is extended or adjusted under 35 U.S.C. 154(b) by 0 days.

(21) Appl. No.: 10/114,209

(22) Filed: Apr. 2, 2002

(65) Prior Publication Data

US 2002/0145872 A1 Oct. 10, 2002

Related U.S. Application Data

(60) Provisional application No. 60/282,836, filed on Apr. 10, 2001.

(51) Int. Cl.[7] ..... F21V 21/088

(52) U.S. Cl. ..... 362/249; 362/396; 362/806

(58) Field of Search ..... 362/122, 124, 362/133, 367, 396, 398, 805, 806, 249, 134, 140

(56) References Cited

U.S. PATENT DOCUMENTS 816,996 A * 4/1906 Plass ..... 362/122
1,639,493 A * 8/1927 Fischer ..... 362/124
3,735,118 A * 5/1973 Martin et al. ..... 362/226
6,394,624 B1 * 5/2002 Hsu ..... 362/806

* cited by examiner

*Primary Examiner*—Y. My Quach-Lee
(74) *Attorney, Agent, or Firm*—Grimes & Battersby, LLP

(57) ABSTRACT

A decorative frame is provided comprising a rigid support structure composed of a plurality of elongated members that define a frame upon which may be mounted a variety of different decorative elements, including decorative fabrics, metal, glass and plastic, which elements may be configured in an ornamental pattern, such as a floral or abstract design. In addition to the means for attaching the decorative elements to the front of the frame, means for attaching the frame to a lighting fixture, such as a bar-type lighting fixture typically found in bathrooms, are also provided, said means being generally disposed on the rear of the frame. While in the preferred embodiment the shape of the decorative frame is generally rectangular, a variety of other shapes are similarly contemplated, such as arcuate, circular, toroidal, pyramidal or trapezoidal.

12 Claims, 3 Drawing Sheets

DECORATIVE LIGHTING FRAME

This application claims the benefit of provisional Appl. No. 60/282,836, filed Apr. 10, 2001.

BACKGROUND OF THE INVENTION

1 . Field of the Invention

The present invention relates generally to lighting fixtures, and, more particularly, to a decorative lighting frame designed to fit over an existing light fixture such as a bar-type lighting fixture typically found in bathrooms and adapted to support a decorative element or fabric on the exterior thereof so as to create a varied lighting effect, thereby enhancing the appearance of the lighting fixture.

2. Description of the Prior Art

The prior art fails to specifically address either the problem or the solution arrived upon by applicant.

Decorative lighting elements have long been known and used for enhancing the appearance of lighting frames. Many of these decorative lighting elements take the form of lampshades and the like which are affixed above or around a lighting element so as to shade or color the light. For example, U.S. Pat. No. 4,731,716, which issued to Chang on Mar. 15, 1988 for a "Collapsible lamp-shade structure"discloses a lamp-shade structure for a decorative lamp having inner and an outer lamp-shades, the inner lamp-shade including annular members and a flexible material stretched therebetween, while the outer lamp-shade is composed of a number of frame members which are abutted one upon another at their sides to assume a polygonal shade around the inner lamp-shade.

Another example of a decorative lampshade is shown in U.S. Pat. No. 6,302,566, which issued to Cohon on Oct. 16, 2001 for a "Removable lampshade drape," which discloses a drape mounted on a support which is mounted on a lampshade or lamp, which drape is suspended from extensions that extend from the exterior surface of the support. U.S. Pat. No. 5,532,912, which issued to Bendit on Jul. 2, 1996 for a "Clampshade" discloses a lamp shade dressing kit that secures decorative material to a manufactured lamp shade in a non-destructive, visually non-obvious manner, permitting the subsequent removal or exchange of the material.

The prior art also includes a variety of devices that are designed to redirect or diffuse the light generated by a lighting frame. By way of example, U.S. Pat. No. 4,903,175, which issued to Cotton on Feb. 20, 1990 for a "Illumination module" discloses an illumination module comprising a housing having one or more cavities, each containing a source of illumination, and a movable mask containing one or more apertures to configure and position the light as it leaves the housing through a window so that one or more segregated targets can be illuminated by means of the single mask positioning of the apertures relative to the open end of the individual cavities.

A diffuser apparatus is shown in U.S. Pat. No. 4,891,737, which issued to Szymanek on Jan. 2, 1990 for a "Quick fit diffuser lens apparatus," which discloses a quick fit lens including a lens body having a transparent face wall and formed with a channel disposed in confronting relationship with respect thereto for sliding receipt of a planar diffuser light panel. Another example of a diffuser device is shown in U.S. Pat. No. 4,045,665, which issued to Williams, et al. on Aug. 30, 1977 for a "Diffuser attachment for a fluorescent lamp fixture" and discloses a light diffuser attachment adapted for use with a self contained fluorescent lamp fixture, said attachment including beads laterally spaced apart from each other to define a flange or rim receiving channel therebetween which receives a diffuser receiving flange or rim of the fixture body cover therein.

Similar devices are also disclosed in U.S. Pat. No. 1,904,121, which issued to Stetner on Apr. 18, 1933; U.S. Pat. No. 2,078,370, which issued to Corbett on Apr. 27, 1937; U.S. Pat. No. 1,440,301, which issued to Klein on Dec. 26, 1922; U.S. Pat. No. 2,397,466, which issued to Bryant on Apr. 2, 1946; U.S. Pat. No. 2,669,651, which issued to MacFadden on Feb. 16, 1954; U.S. Pat. No. 1,786,787, which issued to Steinmeyer on Dec. 30, 1930; U.S. Pat. No. 2,332,138, which issued to Epstein on Oct. 19, 1943; U.S. Pat. No. 2,274,612, which issued to Johnston on Feb. 24, 1942; and U.S. Pat. No. 2,740,216, which issued to Lieberman on Apr. 3, 1956.

As will be appreciated, none of these prior patents even address the problem faced by applicant let alone offer the solution proposed herein.

SUMMARY OF THE INVENTION

Against the foregoing background, it is a primary object of the present invention to provide a decorative lighting frame for covering and aesthetically enhancing an existing lighting fixture.

It is another object of the present invention to provide such a decorative frame that may be easily mounted to an existing lighting fixture.

It is yet another object of the present invention to provide such a decorative frame upon which may be interchangeably attached a variety of decorative elements.

It is still another object of the present invention to provide such a decorative frame that is inexpensive to manufacture.

It is yet another object of the present invention to provide such a decorative frame that may be attached to a variety of fixtures of different shapes and sizes.

It is but another object of the present invention to provide such a decorative frame that is safe to mount to an existing lighting fixture.

It is yet still another object of the present invention to provide such a decorative frame that may be used to decorate lighting fixtures in both residential and commercial spaces.

To the accomplishments of the foregoing objects and advantages, the present invention, in brief summary, comprises a rigid support structure composed of a plurality of elongated members that define a frame upon which may be mounted a variety of different decorative elements, including decorative fabrics, metal, glass and plastic, which elements may be configured in an ornamental pattern, such as a floral or abstract design. Other decorative elements, such as beading and fringe can also be added to the decorative elements to further enhance the aesthetic appeal. In addition to the means for attaching the decorative elements to the front of the frame, means for attaching the frame to a lighting fixture, such as a bar-type lighting fixture typically found in bathrooms, are also provided, said means being generally disposed on the rear of the frame. Examples of such means include clasps, clamps and even magnetic attachment devices. While in the preferred embodiment the shape of the decorative frame is generally rectangular, a variety of other shapes are similarly contemplated, such as arcuate, circular, toroidal, pyramidal or trapezoidal.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1:
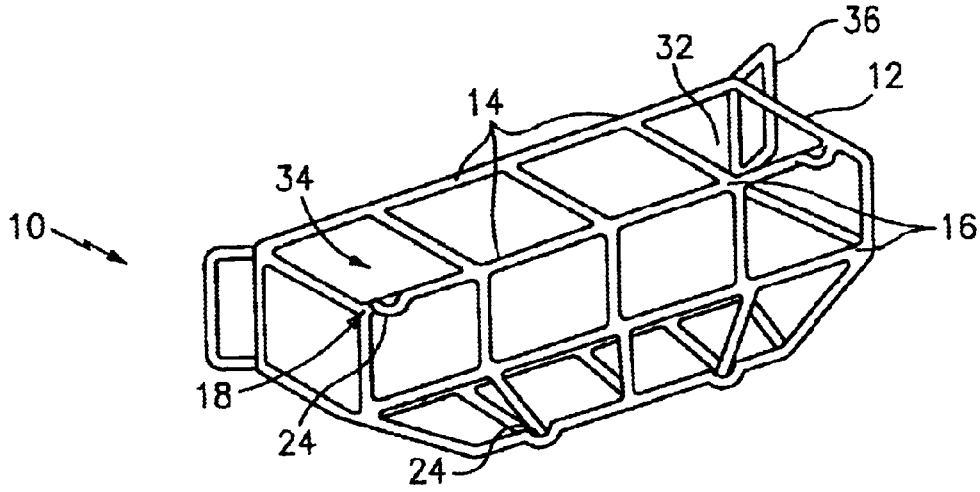
FIG. 1 is a front perspective view of the decorative lighting frame of the present invention.
Figure 2:
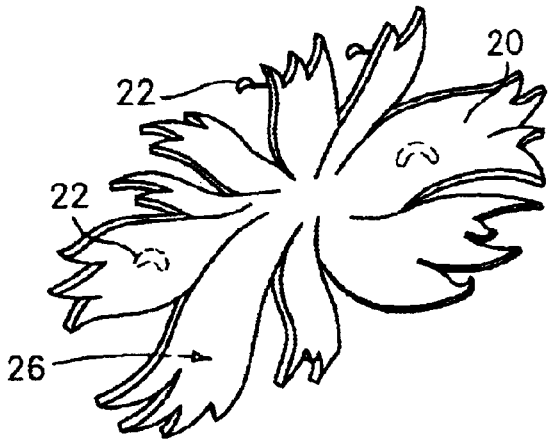
FIG. 2 is a front perspective view of the decorative element component of the decorative lighting frame of the present invention.
Figure 3:
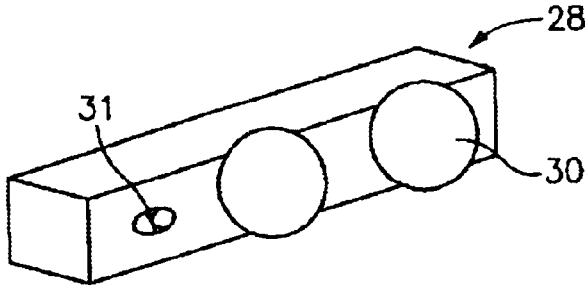
FIG. 3 is a front perspective view of the lighting fixture upon which the decorative lighting frame of the present invention is to be mounted.
Figure 4:
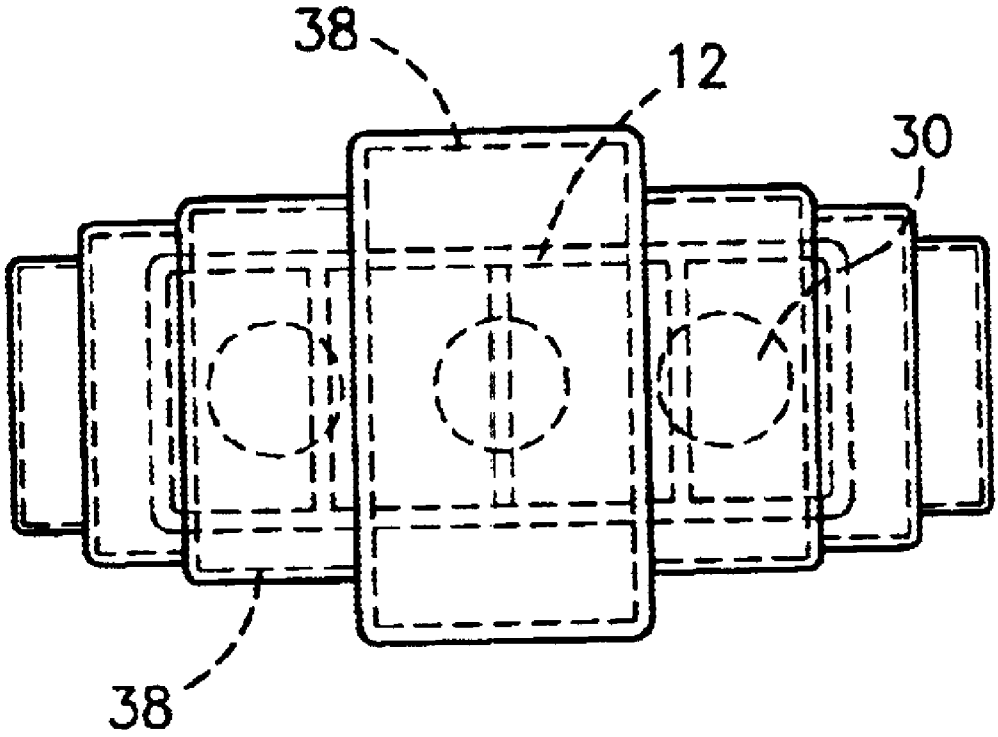
FIG. 4 is front view of the decorative element mounted on the decorative frame of FIG. 1.
Figure 5:
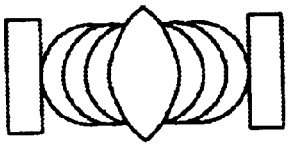
FIGS. 5 through 11 are front views of alternative embodiments of the decorative element component of the decorative lighting fixture of the present invention.
Figure 7:
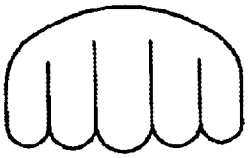
Figure 6:
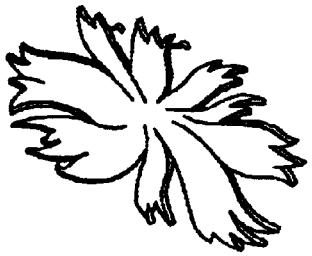
Figure 8:
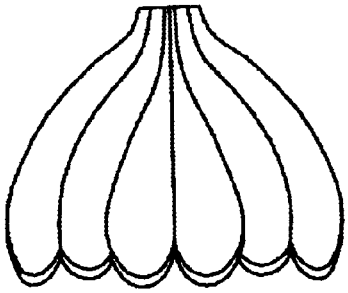
Figure 9:
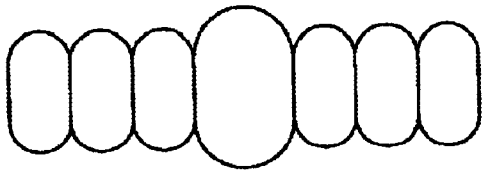
Figure 10:
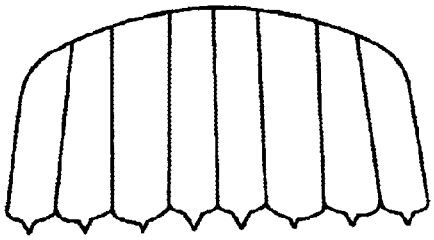
Figure 11:
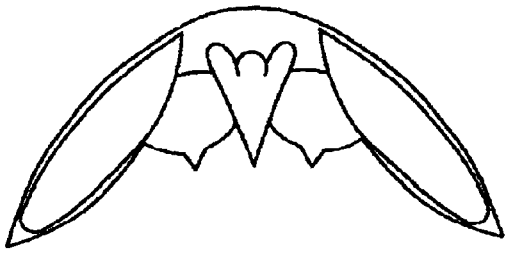

Referring to the drawings and, in particular, to FIG. 1 and FIG. 4 thereof, the decorative frame of the present invention, referred to generally by reference numeral 10, is illustrated. The decorative frame 10 consists of a support structure 12 having a plurality of interlocking elongated members 14 joined at connection points 16. In the preferred embodiment, the arrangement of the elongated members 14 is such that the support structure 12 resembles a cage.

In the preferred embodiment, the support structure 12 is composed of a rigid material, such as eight gauge steel wire, so as to prevent deformation of the frame 10 and to support the weight of any decorative pieces placed and mounted thereon. In such embodiment, the wire is tack welded at the connection points 16 of the elongated members 14. The wire may also be wrapped with binding. However, it should be appreciated that the structure 12 may also be composed of a slightly malleable material so as to allow the shape of the structure 12 to be altered while still providing the requisite support to hold all the decorative structures.

Mounted on the support structure 12 is at least one attachment means 18 adapted to releasably retain a decorative element 20. In the preferred embodiment, the attachment means 18 consists of at least one hook 22 and at least one corresponding loop 24 or similar protrusion, said hook 22 extending from the rear surface 26 of the decorative element 20 and said loop 24 disposed on said support structure. Alternatively, the location of the hook 22 and loop 24 may switched. It should be appreciated, however, that other means for attaching the decorative element 20 to the support structure 12 are contemplated, including snaps, clamps, clasps and even magnetic elements. Furthermore, while in the preferred embodiment the decorative element 20 is designed to be releasably attached to the support structure 12, the attachment may be made permanent by welding, screwing or otherwise permanently mounting the decorative element 20 to the support structure 12.

The size and shape of the support structure 12 is limited only by the size and shape of the lighting fixture 28 to which the decorative frame 10 is to be attached. In the preferred embodiment, the decorative frame 10 is designed to be affixed to a bar-type lighting fixture 28 of the type typically found in a bathroom. In such embodiment, the support structure is at least approximately 36 inches long, inasmuch as such fixtures are typically 36 inches in length. Furthermore, the depth of the support structure 12 for such embodiment would be at least 12 inches deep, which depth would ensure that the support structure 12 and decorative element 20 do not come into contact with any light bulbs 30 that are placed in the sockets 31 of the lighting fixture 28.

The support structure 12 itself may be mounted to the lighting fixture 28 by a variety of means, although in the preferred embodiment, the support structure 12 is attached by means of a compression fitting between the support structure 12 and the lighting fixture 28. In such embodiment, the support structure 12 is shaped so as to create a hollow cavity 32, which cavity 32 has approximately the same cross-sectional shape as the lighting fixture 28. Access to the cavity is made through an opening 34, which opening is also defined by the elongated members 14 of the support structure 12, and which opening also has approximately the same cross-sectional shape as the lighting fixture 28 so as to allow the support structure to mounted slidably about the lighting fixture 28. The cavity 32 in such embodiment is large enough to accommodate the entire lighting fixture 28, including the light bulbs 30 attached thereto, while providing enough spacing between the light bulbs 30 and the support structure 12 so as to prevent the heat generated by the light bulbs 30 from potentially igniting the support structure 12 or decorative element 20. The frame 10 is slidably attached to the lighting fixture 28 and is held in place by means of the frictional contact between the support structure 12 and the surface of the lighting fixture 28. In the event that the elongated members 14 are composed of a malleable material, said members 14 may be deformed somewhat so as to increase the frictional contact with the lighting fixture 28. Alternatively, the support structure 12 may be mounted directly to the wall, using screw, nails, clasps or similar fasteners.

In order to improve the compression fit between the support structure 12 and the lighting fixture 28, clamping members 36 may be disposed at either end, or at the top and bottom, of the support structure 12. In the preferred embodiment, the clamping members 36 are movable or flexible extensions of the support structure 12 that serve to increase the frictional pressure against the lighting fixture 28 by being bent or biased against the lighting fixture 28. In order to further increase this frictional pressure, the clamping members 36 may be composed of, or be partially covered by, a material with a relatively high coefficient of friction, such as rubber.

While in the preferred embodiment the support structure 12 is attached to the lighting fixture 28 by means of a compression fit, other attachment means are contemplated. For example, clasps or clamping means may be utilized, as may magnetic attachment means. It should be appreciated, however, that whatever attachment means is implemented, the support structure 12 must be removable from the lighting fixture 28 so as to allow for changing of the light bulbs 30.

The decorative element 20 is shaped as sized in the preferred embodiment so as to cover the support structure 12, although it is certainly conceivable that the decorative element 20 may be made smaller, particularly if the elongated members 14 making up the support structure 12 are disposed in an aesthetically pleasing arrangement. In its simplest form, the decorative element 20 may consist merely of a fabric or other material that serves to diffuse and color the light emitted by the light bulbs 30. Similarly, a frame 38 made of a rigid material such as metal or plastic may be used to provide shape to the fabric or other material. However, much more complex structures are also contemplated, said structures being formed of metal, plastic, glass, fabric or other materials so as to create fanciful or ornamental designs such as floral patterns or collages, as shown in FIGS. 5 through 11.

Having thus described the invention with particular reference to the preferred forms thereof, it will be obvious that various changes and modifications can be made therein without departing from the spirit and scope of the present invention as defined by the appended claims.

I claim:

1. A decorative lighting frame for mounting about an existing rectangular bar-type lighting fixture having two or more sockets for light bulbs, said frame including:

a rigid support structure composed of a plurality of elongated members that define a cavity having an opening thereto, said cavity and said opening being at least as large as said lighting fixture, wherein said support structure is formed so as to cover said fixture and to allow sufficient spacing between said light bulbs and said support structure to prevent contact therebetween;

means for removably attaching said support structure to said lighting fixture;

a decorative element for covering said support structure; and attaching means for releasably attaching said decorative element to said support structure.

2. The decorative lighting frame of claim 1, wherein said decorative element is a fabric cover.

3. The decorative lighting frame of claim 1, wherein said decorative element comprises a rigid frame upon which are disposed decorative materials selected from the group consisting of fabric, glass, plastic and metal.

4. The decorative lighting frame of claim 1, wherein said attaching means for releasably attaching said decorative element to said support structure comprises at least one hook disposed on said decorative element and at least one corresponding loop disposed on said support structure, wherein said hook is adapted to be inserted into and retained by said loop.

5. The decorative lighting frame of claim 1, wherein said attaching means for releasably attaching said decorative element to said support structure comprises at least one loop disposed on said decorative element and at least one corresponding hook disposed on said support structure, wherein said hook is adapted to be inserted into and retained by said loop.

6. The decorative lighting frame of claim 1, wherein said attaching means for releasably attaching said decorative element to said support structure comprises at least one magnet disposed on said decorative element and at least one corresponding magnet disposed on said support structure, wherein said hook is adapted to be inserted into and retained by said loop.

7. The decorative lighting frame of claim 1, wherein said means for removably attaching said support structure to said lighting fixture comprises clamping members disposed on opposite ends of said support structure and adapted to frictionally engage said lighting fixture.

8. The decorative lighting frame of claim 1, wherein said elongated members are composed of wire.

9. The decorative lighting frame of claim 1, wherein said frame is rectangular in shape.

10. The decorative lighting frame of claim 1, wherein said frame is arcuate in shape.

11. A decorative lighting frame for mounting about an existing rectangular bar-type lighting fixture having two or more sockets for light bulbs, said frame including:

a rigid support structure composed of a plurality of elongated wire members that define a cavity having an opening thereto, said cavity and said opening being at least as large as said lighting fixture, wherein said support structure is formed so as to cover said fixture and to allow sufficient spacing between said light bulbs and said support structure to prevent contact therebetween;

means for removably attaching said support structure to said lighting fixture, said means comprising clamping members disposed on opposite ends of said support structure and adapted to frictionally engage said lighting fixture;

a decorative element for covering said support structure; and attaching means for releasably attaching said decorative element to said support structure, said means comprising at least one hook disposed on said decorative element and at least one corresponding loop disposed on said support structure, wherein said hook is adapted to be inserted into and retained by said loop.

12. A method for mounting a decorative lighting frame to an existing rectangular bar-type lighting fixture having two or more sockets for light bulbs, said method comprising the steps of:

providing a decorative lighting frame comprising:

a rigid support structure composed of a plurality of elongated members that define a cavity having an opening thereto, said cavity and said opening being at least as large as said lighting fixture, wherein said support structure is formed so as to cover said fixture and to allow sufficient spacing between said light bulbs and said support structure to prevent contact therebetween;

means for removably attaching said support structure to said lighting fixture;

a decorative element for covering said support structure; and attaching means for releasably attaching said decorative element to said support structure;

releasably securing said support structure to said lighting fixture; and releasably securing said decorative element to said support structure.

* * * * *